US010458140B2

(12) United States Patent
Haney et al.

(10) Patent No.: US 10,458,140 B2
(45) Date of Patent: Oct. 29, 2019

(54) MODULAR PROCESSING FACILITY

(71) Applicant: Fluor Technology Corporation, Sugar Land, TX (US)

(72) Inventors: Fred Haney, Calgary (CA); Gary Donovan, Canmore (CA); Todd Roth, Calgary (CA); Alan Lowrie, Calgary (CA); George Morlidge, Okotoks (CA); Simon Lucchini, Calgary (CA); Sean Halvorsen, Calgary (CA)

(73) Assignee: Fluor Technologies Corporation, Sugar Land, TX (US)

( * ) Notice: Subject to any disclaimer, the term of this patent is extended or adjusted under 35 U.S.C. 154(b) by 385 days.

(21) Appl. No.: 14/747,727

(22) Filed: Jun. 23, 2015

(65) Prior Publication Data

US 2015/0292223 A1 Oct. 15, 2015

Related U.S. Application Data

(62) Division of application No. 14/527,425, filed on Oct. 29, 2014, now Pat. No. 9,376,828, which is a division (Continued)

(51) Int. Cl.
*E04H 5/02* (2006.01)
*E04H 1/00* (2006.01)

(52) U.S. Cl.
CPC ..... *E04H 5/02* (2013.01); *E04H 1/00* (2013.01); *E04H 1/005* (2013.01)

(58) Field of Classification Search
CPC ... E04H 5/02; C10G 2300/4068; E04F 17/08; E04C 2/521; E04B 2001/0053
See application file for complete search history.

(56) References Cited

U.S. PATENT DOCUMENTS 3,274,745 A 9/1966 McManus et al.
3,643,389 A 2/1972 Sheppley, Jr.
(Continued)

FOREIGN PATENT DOCUMENTS

AU 2010330872 A1 8/2014
AU 2014202657 B2 10/2016
(Continued)

OTHER PUBLICATIONS

U.S. Appl. No. 12/971,365, Office Action dated Jul. 20, 2012, 14 pages.

(Continued)

*Primary Examiner* — Brian E Glessner
*Assistant Examiner* — Daniel J Kenny
(74) *Attorney, Agent, or Firm* — Conley Rose, PC

(57) ABSTRACT

The various processes of a plant are segmented into separate process blocks that are connected to one another using fluid conduits or electrical connections. Each process block is specialized to perform specific tasks in an assembly line manner to achieve an overall goal. For example, multiple distillation process blocks could be daisy-chained to create fuel from crude oil. Each process block is generally small enough to be mounted on a truck or a flatbed for easy transport, allowing for an assembly line of process blocks to be transported anywhere in the world with ease.

20 Claims, 7 Drawing Sheets

PROCESS BLOCK, MODULE AND EQUIPMENT LAYOUT
PLAN VIEW

Related U.S. Application Data of application No. 12/971,365, filed on Dec. 17, 2010, now Pat. No. 8,931,217.

(60) Provisional application No. 61/287,956, filed on Dec. 18, 2009.

(56) References Cited

U.S. PATENT DOCUMENTS

| | | | | |
|---|---|---|---|---|
| 3,707,165 | A | 12/1972 | Stahl | |
| 3,925,679 | A | 12/1975 | Berman et al. | |
| 4,055,050 | A | 10/1977 | Kozlov | |
| 4,267,822 | A | 5/1981 | Diamond | |
| 4,452,312 | A | 6/1984 | Roblin | |
| 4,457,116 | A | 7/1984 | Kump | |
| 4,527,981 | A | 7/1985 | Chisum | |
| 5,474,411 | A | 12/1995 | Schoenfeld et al. | |
| 6,116,050 | A | 9/2000 | Yao et al. | |
| 6,176,046 | B1 | 6/2001 | Quine et al. | |
| 6,308,465 | B1 | 10/2001 | Galloway et al. | |
| 6,581,698 | B1 | 6/2003 | Dirks | |
| 6,751,984 | B2 | 6/2004 | Neeraas et al. | |
| 6,786,051 | B2 | 9/2004 | Kristich et al. | |
| 6,862,487 | B2 * | 3/2005 | Yamanaka | B65G 37/02 700/112 |
| 7,051,553 | B2 | 5/2006 | Mak et al. | |
| 7,216,507 | B2 | 5/2007 | Cuellar et al. | |
| 8,070,389 | B2 | 12/2011 | Ayers et al. | |
| 8,097,451 | B2 | 1/2012 | Gaalswyk | |
| 8,151,537 | B2 | 4/2012 | Pope | |
| 8,157,003 | B2 | 4/2012 | Hackett et al. | |
| 8,535,419 | B2 | 9/2013 | Wind et al. | |
| 8,621,786 | B2 * | 1/2014 | Lam | E04H 5/02 52/174 |
| 8,671,625 | B2 | 3/2014 | Imaoka et al. | |
| 8,931,217 | B2 | 1/2015 | Haney et al. | |
| 9,376,828 | B2 | 6/2016 | Haney et al. | |
| 2005/0241823 | A1 | 11/2005 | Beato et al. | |
| 2006/0124354 | A1 | 6/2006 | Witte | |
| 2008/0000644 | A1 | 1/2008 | Tsilevich et al. | |
| 2008/0029447 | A1 | 2/2008 | Gaalswyk | |
| 2008/0127662 | A1 | 6/2008 | Stanfield et al. | |
| 2010/0132390 | A1 | 6/2010 | Platt et al. | |
| 2011/0146164 | A1 | 6/2011 | Haney et al. | |
| 2012/0193093 | A1 | 8/2012 | James | |
| 2013/0066772 | A1 | 3/2013 | Xiong | |
| 2013/0067721 | A1 | 3/2013 | Scannon et al. | |
| 2013/0313886 | A1 | 11/2013 | Van Der Merwe et al. | |
| 2014/0018589 | A1 | 1/2014 | Iyer et al. | |
| 2014/0053599 | A1 | 2/2014 | Byfield | |
| 2015/0210610 | A1 | 7/2015 | Rafique et al. | |
| 2015/0292223 | A1 | 10/2015 | Haney et al. | |
| 2017/0159305 | A1 | 6/2017 | Haney et al. | |
| 2017/0216766 | A1 | 8/2017 | Mogose et al. | |
| 2018/0220552 | A1 | 8/2018 | Arcot et al. | |

FOREIGN PATENT DOCUMENTS

| | | | |
|---|---|---|---|
| CA | 2596139 | | 2/2008 |
| CA | 2596139 | A1 | 2/2008 |
| CA | 2724938 | C | 1/2017 |
| CL | 51559 | | 11/2015 |
| CN | 106948490 | A | 7/2017 |
| EP | 0006015 | A1 | 12/1979 |
| EP | 0059376 | A1 | 9/1982 |
| EP | 0572814 | A1 | 8/1993 |
| EP | 0572814 | B1 | 10/1995 |
| EP | 2516759 | A1 | 10/2012 |
| EP | 3419761 | | 1/2019 |
| FR | 2563559 | A1 | 10/1985 |
| GC | 0003790 | | 3/2016 |
| MX | 337599 | | 3/2016 |
| PH | 12012501218 | | 6/2015 |
| WO | 03/031012 | | 4/2003 |
| WO | 03031012 | A1 | 4/2003 |
| WO | 2003031012 | A1 | 4/2003 |
| WO | 2003031015 | A1 | 4/2003 |
| WO | 2006055953 | A1 | 5/2006 |
| WO | 2011075625 | A1 | 6/2011 |
| WO | 2012100320 | A1 | 8/2012 |
| WO | 2017147405 | A1 | 8/2017 |
| WO | 2018144204 | A1 | 8/2018 |
| ZA | 201205131 | | 12/2014 |

OTHER PUBLICATIONS

U.S. Appl. No. 12/971,365, Final Office Action dated Dec. 21, 2012, 12 pages.

U.S. Appl. No. 12/971,365, Office Action dated Apr. 3, 2013, 13 pages.

U.S. Appl. No. 12/971,365, Final Office Action dated Aug. 23, 2013, 13 pages.

U.S. Appl. No. 12/971,365, Advisory Action dated Nov. 4, 2013, 3 pages.

U.S. Appl. No. 12/971,365, Office Action dated Jan. 16, 2014, 11 pages.

U.S. Appl. No. 12/971,365, Final Office Action dated May 22, 2014, 9 pages.

U.S. Appl. No. 12/971,365, Advisory Action dated Aug. 7, 2014, 2 pages.

U.S. Appl. No. 12/971,365, Notice of Allowance dated Sep. 11, 2014, 10 pages.

U.S. Appl. No. 14/527,425, Office Action dated Oct. 8, 2015, 12 pages.

U.S. Appl. No. 14/527,425, Notice of Allowance dated Jan. 29, 2016, 7 pages.

Dr. Shenoy, Arkal and Dr. Telengator, Alexander, "Modular Helium Reactor (MHR) for Oil Sands Extraction", General Atomics, 3550 General Atomics Court, San Diego, CA 92121, 2 pages, [retrieved on Jan. 26, 2017]. Retrieved from Internet: <URL: https://cns-snc.ca/media/past_conferences/CNS2009/proposals/Arkal%20Shenoy%20Proposal.pdf>.

International Patent Application No. PCT/US2010/060969, International Search Report dated Mar. 7, 2011, 2 pages.

International Patent Application No. PCT/US2010/060969, Written Opinion of the International Searching Authority dated Mar. 7, 2011, 4 pages.

International Patent Application No. PCT/US2010/060969, International Preliminary Report on Patentability dated Jun. 19, 2012, 5 pages.

GCC Patent Application No. 2010/17384, Examination Report dated May 7, 2014, 5 pages.

GCC Patent Application No. 2010/17384, Examination Report dated Aug. 27, 2014, 4 pages.

Chile Patent Application No. 1469-2010, Office Action dated Mar. 22, 2013, 8 pages.

Chile Patent Application No. 1469-2010, Office Action dated Feb. 7, 2014, 7 pages.

Chile Patent Application No. 1469-2010, Notice of Grant dated Nov. 27, 2015, 2 pages.

Canada Patent Application No. 2,724,938, Office Action dated Jun. 10, 2013, 3 pages.

Canada Patent Application No. 2,724,938, Office Action dated Jan. 30, 2014, 4 pages.

Canada Patent Application No. 2,724,938, Notice of Allowance dated Oct. 22, 2014, 1 page.

Canada Patent Application No. 2,724,938, Office Action dated May 12, 2015, 4 pages.

Canada Patent Application No. 2,724,938, Office Action dated Mar. 2, 2016, 3 pages.

Canada Patent Application No. 2,724,938, Notice of Allowance dated Dec. 16, 2016, 1 page.

Australia Patent Application No. 2010330872, Examination Report No. 1 dated Nov. 1, 2013, 3 pages.

Australia Patent Application No. 2010330872, Notice of Acceptance dated Apr. 10, 2014, 10 pages.

Philippines Patent Application No. 12012501218, Examination Report dated Jul. 26, 2013, 1 page.

(56) References Cited

OTHER PUBLICATIONS

Philippines Patent Application No. 12012501218, Examination Report dated Sep. 18, 2014, 4 pages.
Philippines Patent Application No. 12012501218, Examination Report dated Feb. 2, 2015, 3 pages.
Mexico Patent Application No. MX/A/2012/007092, Translation of Office Action, dated Nov. 6, 2014, 2 pages.
Mexico Patent Application No. MX/A/2012/007092, Translation of Office Action, dated Jun. 24, 2015, 2 pages.
Europe Patent Application No. 10838282.1, Invitation Pursuant to Rule 62a(1) EPC, dated Jun. 6, 2014, 2 pages.
Europe Patent Application No. 10838282.1, Search Report and Written Opinion, dated Oct. 6, 2014, 8 pages.
Europe Patent Application No. 10838282.1, Examination Report, dated Sep. 23, 2016, 4 pages.
China Patent Application No. 201080064231.9, Office Action, dated Jan. 27, 2014, 17 pages.
China Patent Application No. 201080064231.9, Office Action, dated Sep. 19, 2014, 16 pages.
China Patent Application No. 201080064231.9, Decision on Rejection, dated May 6, 2015, 20 pages.
China Patent Application No. 201080064231.9, Notice of Reexamination, dated Apr. 6, 2016, 15 pages.
China Patent Application No. 201080064231.9, Reexamination Decision, dated Nov. 22, 2016, 26 pages.
Australia Patent Application No. 2014202657, Examination Report No. 1, dated Jun. 19, 2015, 2 pages.
Australia Patent Application No. 2014202657, Examination Report No. 2, dated Jun. 14, 2016, 4 pages.
Australia Patent Application No. 2014202657, Notice of Acceptance, dated Jun. 28, 2016, 2 pages.
Arcot, Srinivas et al U.S. Patent Application entitled "Modular Processing Facility With Distributed Cooling Systems", filed Jan. 31, 2017 U.S. Appl. No. 15/420,965, 47 pages.
Haney, Fred et al U.S. Patent Application entitled "Modular Processing Facility", filed Feb. 23, 2017 U.S. Appl. No. 15/440,8125, 43 pages.
Haney, Fred et al PCT Patent Application entitled "Modular Processing Facility", filed Feb. 23, 2017 U.S. Appl. No. 15/440,8125, 32 pages.
Haney, Fred et al China Patent Application entitled "Modular Processing Facility ", filed Feb. 21, 2017 Application No. 201710094489. 7, 31 pages.
International Application No. PCT/US2017/019329, International Search Report, dated May 22, 2017, 3 pages.
International Application No. PCT/US2017/019329, Written Opinion of the International Searching Authority, dated May 22, 2017, 7 pages.
Office Action dated May 31, 2019, U.S. Appl. No. 15/440,812, filed Feb. 23, 2017.
Chinese Patent Application No. 201710094489.7, Search Report dated Sep. 18, 2018, 3 pages.
Chinese Patent Application No. 201710094489.7, Office Action dated Sep. 28, 2018, 17 pages.
Haney, Fred, et al., entitled "Modular Processing Facility", filed Dec. 18, 2009, U.S. Appl. No. 61/287,956.
Moore, Bernie, et al., entitled, "Integrated Configuration for a Steam Assisted Gravity Drainage Central Processing Facility," filed Oct. 20, 2017, U.S. Appl. No. 62/575,209.
Moore, Bernie, et al., entitled, "Integrated Configuration for a Steam Assisted Gravity Drainage Central Processing Facility," filed Oct. 19, 2018, U.S. Appl. No. 16/165,240.
Office Action dated Oct. 18, 2018, U.S. Appl. No. 15/440,812, filed Feb. 23, 2017.
Restriction Requirement dated Aug. 3, 2018, U.S. Appl. No. 15/440,812 filed Feb. 23, 2017.
International Application No. PCT/US2018/013346, Search Report and Written Opinion dated Apr. 25, 2018.
European Patent Application No. 10838282.1, Communication Pursuant to Article 94(3) EPC, dated Jun. 7, 2018, 4 pages.
Haney, Fred et al U.S. Appl. No. 61/287,956, entitled "Modular Processing Facility", filed Dec. 18, 2018.
Haney, Fred et al.,U.S. Appl. No. 62/579,560 entitled "Cracker Modular Processing Facility", filed Oct. 31, 2017.
International Patent Application No. PCT/US2017/019329, International Preliminary Report on Patentability dated Sep. 7, 2018, 9 pages.
Advisory Action dated Apr. 30, 2019, U.S. Appl. No. 15/440,812, filed Feb. 23, 2017.
Intellectual Property India, Government of India, Examination Report dated Feb. 28, 2018, 5 pages.
Brazilian Patent Application No. BR112012014815-0, Office Action dated Dec. 24, 2018, 7 pages.
Indonesian Patent Application No. WO0201202728, Office Action dated Dec. 17, 2018, 2 pages.
European Application No. 17757290.6, Communication pursuant to Rules 161(2) and 162 EPC dated Oct. 5, 2018, 3 pages.
International Application No. PCT/US18/58358, International Search Report, dated Jan. 16, 2019, 9 pages.
Office Action dated Feb. 25, 2019, U.S. Appl. No. 15/420,965, filed Jan. 31, 2017.
Final Office Action dated Feb. 7, 2019, U.S. Appl. No. 15/440,812, filed Feb. 23, 2017.

* cited by examiner

100

3rd Generation Construction Steps

| |
|---|
| 101. Identify the 3rd Generation Construction process facility configuration using process blocks. |
| 102. Allocate plot space for each 3rd Generation Construction process block.<br>102A. Obtain necessary equipment types sizes and weights.<br>102B. Establish an overall geometric area for the process block using a combination of transportable module dimensions<br>102C. Allocate space for the electrical and control distribution panels on the first level.<br>102D. Group the equipment and instruments by primary systems using the process block PFDs.<br>102E. Lay out each grouping of equipment by system onto the process block layout assuring that equipment does not cross module boundaries. |
| 103. Prepare detailed equipment layout within Process Blocks to produce an integrated 3rd Generation facility. |
| 104. Develop a 3rd Generation Module Configuration Table and power and control distribution plan |
| 105. Develop a 3rd Generation Modular Construction plan. |

Figure 1

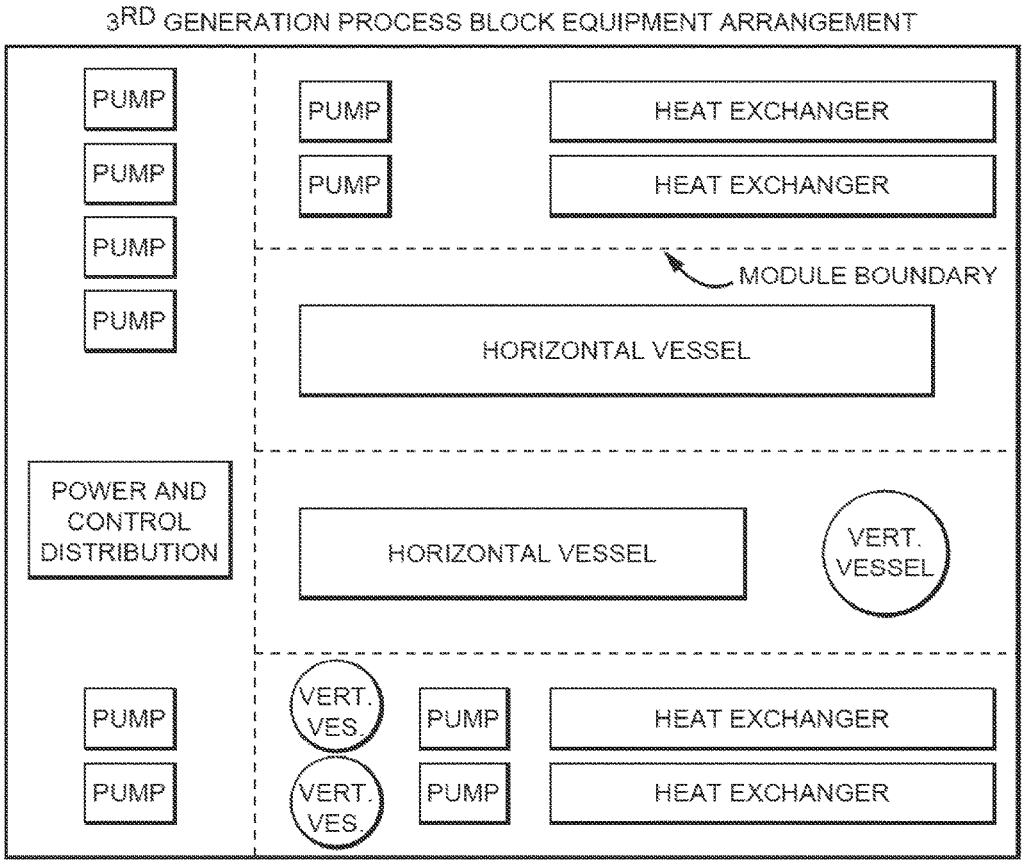
FIG. 2
FIG. 3
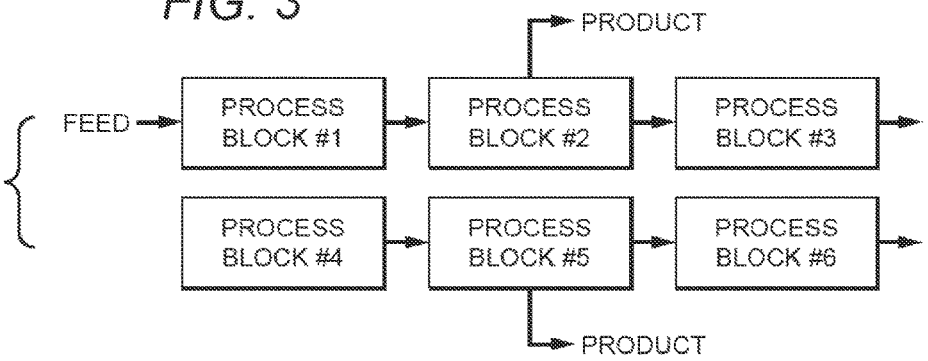

PROCESS BLOCK, MODULE AND EQUIPMENT LAYOUT
PLAN VIEW

Process Block Module Layout
Elevation View

OIL TREATING PROCESS BLOCK #1
SIDE ELEVATION VIEW

MODULAR PROCESSING FACILITY

This application is a divisional of U.S. patent application Ser. No. 14/527,425, filed Oct. 29, 2014, which is a divisional of U.S. patent application Ser. No. 12/971,365, filed Dec. 17, 2010, which claims the benefit of priority to U.S. Provisional Application No. 61/287,956, filed Dec. 18, 2009, which along with all other references concurrently filed are incorporated herein by reference in their entirety.

FIELD OF THE INVENTION

The field of the invention is modular construction of process facilities, with particular examples given with respect to modular oil sand processing facilities.

BACKGROUND

Building large-scale processing facilities can be extraordinarily challenging in remote locations, or under adverse conditions. One particular geography that is both remote and suffers from severe adverse conditions includes the land comprising the western provinces of Canada, where several companies are now trying to establish processing plants for removing oil from oil sands.

Given the difficulties of building a facility entirely on-site, there has been considerable interest in what we shall call 2nd Generation Modular Construction. In that technology, a facility is logically segmented into truckable modules, the modules are constructed in an established industrial area, trucked or airlifted to the plant site, and then coupled together at the plant site. Several 2nd Generation Modular Construction facilities are in place in the tar sands of Alberta, Canada, and they have been proved to provide numerous advantages in terms of speed of deployment, construction work quality, reduction in safety risks, and overall project cost. There is even an example of a Modular Helium Reactor (MHR), described in a paper by Dr. Arkal Shenoy and Dr. Alexander Telengator, General Atomics, 3550 General Atomics Court, San Diego, Calif. 92121.

2nd Generation Modular facilities have also been described in the patent literatures, An example of a large capacity oil refinery composed of multiple, self-contained, interconnected, modular refining units is described in WO 03/031012 to Shumway. A generic 2nd Generation Modular facility is described in US20080127662 to Stanfield.

Unless otherwise expressly indicated herein, Shumway and all other extrinsic materials discussed herein, and in the priority specification and attachments, are incorporated by reference in their entirety. Where a definition or use of a term in an incorporated reference is inconsistent with or contrary to the definition of that term provided herein, the definition of that term provided herein applies and the definition of that term in the reference does not apply.

There are very significant cost savings in using 2nd Generation Modular. It is contemplated, for example, that building of a process module costs US$4 in the field for every US$1 spent building an equivalent module in a construction facility. Nevertheless, despite the many advantages of 2nd Generation Modular, there are still problems. Possibly the most serious problems arise from the ways in which the various modules are inter-connected. In the prior art 2nd Generation Modular units, the fluid, power and control lines between modules are carried by external piperacks. This can be seen clearly in FIGS. 1 and 2 of WO 03/031012. In facilities using multiple, self-contained, substantially identical production units, it is logically simple to operate those units in parallel, and to provide in feed (inflow) and product (outflow) lines along an external piperack. But where small production units are impractical or uneconomical, the use of external piperacks is a hindrance.)

What is needed is a new modular paradigm, in which the various processes of a plant are segmented in process blocks comprising multiple modules. We refer to such designs and implementations as 3rd Generation Modular Construction.

SUMMARY OF THE INVENTION

The inventive subject matter provides apparatus, systems and methods in which the various processes of a plant are segmented in process blocks, each comprising multiple modules, wherein at least some of the modules within at least some of the blocks are fluidly and electrically coupled to at least another of the modules using direct-module to-module connections.

In preferred embodiments, a processing facility is constructed at least in part by coupling together three or more process blocks. Each of at least two of the blocks comprises at least two truckable modules, and more preferably three, four five or even more such modules. Contemplated embodiments can be rather large, and can have four, five, ten or even twenty or more process blocks, which collectively comprise up to a hundred, two hundred, or even a higher number of truckable modules. All manner of industrial processing facilities are contemplated, including nuclear, gas-fired, coal-fired, or other energy producing facilities, chemical plants, and mechanical plants.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

As used herein the term "process block" means a part of a processing facility that has several process systems within a distinct geographical boundary. By way of example, a facility might have process blocks for generation or electricity or steam, for distillation, scrubbing or otherwise separating one material from another, for crushing, grinding, or performing other mechanical operations, for performing chemical reactions with or without the use of catalysts, for cooling, and so forth.

As used herein the term "truckable module" means a section of a process block that includes multiple pieces of equipment, and has a transportation weight between 20,000 Kg and 200,000 Kg. The concept is that a commercially viable subset of truckable modules would be large enough to practically carry the needed equipment and support structures, but would also be suitable for transportation on commercially used roadways in a relevant geographic area, for a particular time of year. It is contemplated that a typical truckable module for the Western Canada tar sands areas would be between 30,000 Kg and 180,000 Kg, and more preferably between 40,000 Kg and 160,000 Kg. From a dimensions perspective, such modules would typically measure between 15 and 30 meters long, and at least 3 meters high and 3 meters wide, but no more than 35 meters long, 8 meters wide, and 8 meters high.

Truckable modules may be closed on all sides, and on the top and bottom, but more typically such modules would have at least one open side, and possibly all four open sides, as well as an open top. The open sides allows modules to be positioned adjacent one another at the open sides, thus creating a large open space, comprising 2, 3, 4, 5 or even more modules, through which an engineer could walk from one module to another within a process block.

A typical truckable module might well include equipment from multiples disciplines, as for example, process and staging equipment, platforms, wiring, instrumentation, and lighting.

One very significant advantage of 3rd Generation Modular Construction is that process blocks are designed to have only a relatively small number of external couplings. In preferred embodiments, for example, there are at least two process blocks that are fluidly coupled by no more than three, four or five fluid lines, excluding utility lines. It is contemplated, however, that there could be two or more process blocks that are coupled by six, seven, eight, nine, ten or more fluid lines, excluding utility lines. The same is contemplated with respect to power lines, and the same is contemplated with respect to control (i.e. wired communications) lines. In each of these cases, fluid, power, and control lines, it is contemplated that a given line coming into a process block will "fan out" to various modules within the process block. The term "fan out" is not meant in a narrow literal sense, but in a broader sense to include situations where, for example, a given fluid line splits into smaller lines that carry a fluid to different parts of the process block through orthogonal, parallel, and other line orientations.

Process blocks can be assembled in any suitable manner. It is contemplated, for example, that process blocks can be positioned end-to-end and/or side-to-side and/or above/below one another. Contemplated facilities include those arranged in a matrix of x by y blocks, in which x is at least 2 and y is at least 3. Within each process block, the modules can also be arranged in any suitable manner, although since modules are likely much longer than they are wide, preferred process blocks have 3 or 4 modules arranged in a side-by-side fashion, and abutted at one or both of their collective ends by the sides of one or more other modules. Individual process blocks can certainly have different numbers of modules, and for example a first process block could have five modules, another process block could have two modules, and a third process block could have another two modules. In other embodiments, a first process block could have at least five modules, another process block could have at least another five modules, and a third process block could have at least another five modules.

In some contemplated embodiments, 3rd Generation Modular Construction facilities are those in which the process blocks collectively include equipment configured to extract oil from oil sands. Facilities are also contemplated in which at least one of the process blocks produces power used by at least another one of the process blocks, and independently wherein at least one of the process blocks produces steam used by at least another one of the process blocks, and independently wherein at least one of the process blocks includes an at least two story cooling tower. It is also contemplated that at least one of the process blocks includes a personnel control area, which is controllably coupled to at least another one of the process blocks using fiber optics. In general, but not necessarily in all cases, the process blocks of a 3rd Generation Modular facility would collectively include at least one of a vessel, a compressor, a heat exchanger, a pump, a filter.

Although a 3rd Generation Modular facility might have one or more piperacks to inter-connect modules within a process block, it is not necessary to do so. Thus, it is contemplated that a modular building system could comprise A, B, and C modules juxtaposed in a side-to-side fashion, each of the modules having (a) a height greater than 4 meters and a width greater than 4 meters, and (b) at least one open side; and a first fluid line coupling the A and B modules; a second fluid line coupling the B and C modules; and wherein the first and second fluid lines do not pass through a common interconnecting piperack.

Various objects, features, aspects and advantages of the inventive subject matter will become more apparent from the following description of exemplary embodiments and accompanying drawing figures.

BRIEF DESCRIPTION OF THE DRAWING

FIG. 1 is a flowchart showing some of the steps involved in $3^{rd}$ Generation Construction process.

FIG. 2 is an example of a 3rd Generation Construction process block showing a first level grid and equipment arrangement.

FIG. 3 is a simple 3rd Generation Construction "block" layout.

DETAILED DESCRIPTION

Figure 4:
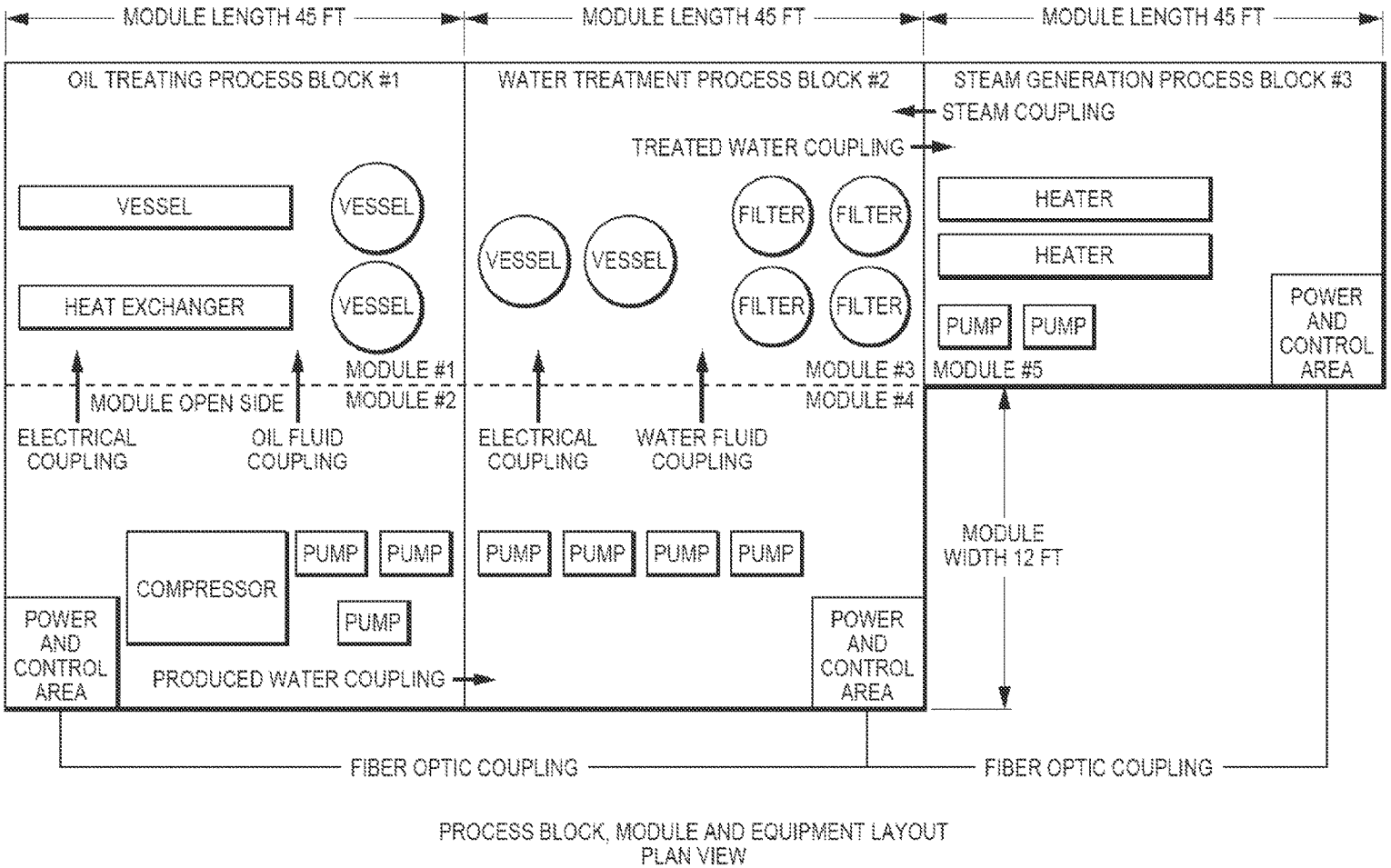
FIG. 4 is a schematic of three exemplary process blocks (#1, #2 and #3) in an oil separation facility designed for the oil sands region of western Canada.

In one aspect of preferred embodiments, the modular building system would further comprise a first command line coupling the A and B modules; a second command line coupling the B and C modules; and wherein the first and second command lines do not pass through the common piperack. In more preferred embodiments, the A, B, and C modules comprise at least, 5, at least 8, at least 12, or at least 15 modules. Preferably, at least two of the A, B and C process blocks are fluidly coupled by no more than five fluid lines, excluding utility lines. In still other preferred embodiments, a D module could be is stacked upon the C module, and a third fluid line could directly couple C and D modules.

Methods of laying out a 2nd Generation Modular facility are different in many respects from those used for laying out a 3rd Generation Modular facility. Whereas the former generally merely involves dividing up equipment for a given process among various modules, the latter preferably takes place in a five-step process as described below. It is contemplated that while traditional 2nd Generation Modular Construction can prefab about 50-60% of the work of a complex, multi-process facility, 3rd Generation Modular Construction can prefab up to about 90-95% of the work Additional information for designing 3rd Generation Modular Construction facilities is included in the 3rd Generation Modular Execution Design Guide, which is included in this application. The Design Guide should be interpreted as exemplary of one or more preferred embodiments, and language indicating specifics (e.g. "shall be" or "must be") should therefore be viewed merely as suggestive of one or more preferred embodiments. Where the Design Guide refers to confidential software, data or other design tools that are not included in this application, such software, data or other design tools are not deemed to be incorporated by reference. In the event there is a discrepancy between the Design Guide and this specification, the specification shall control.

FIG. 1 is a flow chart 100 showing steps in production of a 3rd Generation Construction process facility. In general there are three steps, as discussed below.

Step 101 is to identify the 3rd Generation Construction process facility configuration using process blocks. In this step the process lead typically separates the facilities into process "blocks". This is best accomplished by developing a process block flow diagram. Each process block contains a distinct set of process systems. A process block will have one or more feed streams and one or more product streams. The process block will process the feed into different products as shown in.

Step 102 is to allocate a plot space for each 3rd Generation Construction process block. The plot space allocation requires the piping layout specialist to distribute the relevant equipment within each 3rd Generation Construction process block. At this phase of the project, only equipment estimated sizes and weights as provided by process/mechanical need be used to prepare each "block". A 3rd Generation Construction process block equipment layout requires attention to location to assure effective integration with the piping, electrical and control distribution. In order to provide guidance to the layout specialist the following steps should be followed:

Step 102A is to obtain necessary equipment types, sizes and weights. It is important that equipment be sized so that it can fit effectively onto a module. Any equipment that has been sized and which can not fit effectively onto the module envelop needs to be evaluated by the process lead for possible resizing for effective module installation.

Step 102B is to establish an overall geometric area for the process block using a combination of transportable module dimensions. A first and second level should be identified using a grid layout where the grid identifies each module boundary within the process block.

Step 102C is to allocate space for the electrical and control distribution panels on the first level. FIG. 2 is an example of a 3rd Generation Construction process block first level grid and equipment arrangement. The E&I panels are sized to include the motor control centers and distributed instrument controllers and I/O necessary to energize and control the equipment, instrumentation, lighting and electrical heat tracing within the process block. The module which contains the E&I panels is designated the 3rd Generation primary process block module. Refer to E&I installation details for 3rd Generation module designs.

Step 102D is to group the equipment and instruments by primary systems using the process block PFDs.

Step 102E is to lay out each grouping of equipment by system onto the process block layout assuring that equipment does not cross module boundaries. The layout should focus on keeping the pumps located on the same module grid and level as the E&I distribution panels. This will assist with keeping the electrical power home run cables together. If it is not practical, the second best layout would be to have the pumps or any other motor close to the module with the E&I distribution panels. In addition, equipment should be spaced to assure effective operability, maintainability and safe access and egress.

The use of Fluor's Optimeyes™ is an effective tool at this stage of the project to assist with process block layouts.

Step 103 is to prepare a detailed equipment layout within Process Blocks to produce an integrated 3rd Generation facility. Each process block identified from step 2 is laid out onto a plot space assuring interconnects required between blocks are minimized. The primary interconnects are identified from the Process Flow Block diagram. Traditional interconnecting piperacks are preferably no longer needed or used. Pipeways are integrated into the module. A simple, typical 3rd Generation "block" layout is illustrated in FIG. 3.

Step 104 is to develop a 3rd Generation Module Configuration Table and power and control distribution plan, which combines process blocks for the overall facility to eliminate traditional interconnecting piperacks and reduce number of interconnects. A 3rd Generation module configuration table is developed using the above data. Templates can be used, and for example, a 3rd Generation power and control distribution plan can advantageously be prepared using the 3rd Generation power and control distribution architectural template.

Step 105 is to develop a 3rd Generation Modular Construction plan, which includes fully detailed process block modules on integrated multi-discipline basis. The final step for this phase of a project is to prepare an overall modular 3rd Generation Modular Execution plan, which can be used for setting the baseline to proceed to the next phase. It is contemplated that a 3rd Generation Modular Execution will require a different schedule than traditionally executed modular projects.

Many of the differences between the traditional 1st Generation and 2nd Generation Modular Construction and the 3rd Generation Modular Construction are set forth in Table 1 below, with references to the 3rd Generation Modular Execution Design Guide, which was filed with the parent provisional application:

TABLE 1

| Activities | Traditional Truckable Modular Execution | $3^{rd}$ Gen Modular Execution |
|---|---|---|
| Layout & Module Definition | Steps are:<br>1. Develop Plot Plan using equipment dimensions and Process Flow Diagrams (PFDs). Optimize interconnects between equipment.<br>2. Develop module boundaries using Plot Plan and Module Transportation Envelop.<br>3. Develop detailed module layouts and interconnects between modules and stick-built portions of facilities | Utilize structured work process to develop plot layout based on development of Process Blocks with fully integrated equipment, piping, electrical and instrumentation/controls, including the following steps:<br>1. Identify the 3rd Generation process facility configuration using process blocks using PFDs.<br>2. Allocate plot space for each 3rd Generation process block.<br>3. Detailed equipment layout within Process Blocks using $3^{rd}$ Generation methodology to eliminate traditional |

TABLE 1-continued

| Activities | Traditional Truckable Modular Execution | 3rd Gen Modular Execution |
|---|---|---|
| | utilizing a network of piperack/sleeperways and misc. supports.<br>4. Route electrical and controls cabling through interconnecting racks and misc. supports to connect various loads and instruments with satellite substation and racks.<br>Note: This results in a combination of 1st generation (piperack) and 2nd generation (piperack with selected equipment) modules that fit the transportation envelop.<br>Ref.: Section 1.4 A | interconnecting piperack and minimize or reduce interconnects within Process Block modules. The layout builds up the Process Block based on module blocks that conform to the transportation envelop.<br>4. Combine Process Blocks for overall facility to eliminate traditional interconnecting piperacks and reduce number of interconnects.<br>5. Develop a 3rd Generation Modular Construction plan, which includes fully detailed process block modules on integrated multi-discipline basis<br>Note: This results in an integrated overall plot layout fully built up from Module blocks that conform to the transportation envelop.<br>Ref.: Section 2.2 thru 2.4 |
| Piperacks/ Sleeperways | Modularized piperacks and sleeperways, including cable tray for field installation of interconnects and home-run cables.<br>Ref.: Section 2.5 | Eliminates the traditional modularized piperacks and sleeperways. Interconnects are integrated into Process Block modules for shop installation.<br>Ref.: Section 2.2 |
| Buildings | Multiple standalone pre-engineered and stick built buildings based on discrete equipment housing. | Buildings are integrated into Process Block modules.<br>Ref: Section 3.3D |
| Power Distribution Architecture | Centralized switchgear and MCC at main and satellite substations.<br>Individual home run feeders run from satellite substations to drivers and loads via interconnecting piperacks.<br>Power cabling installed and terminated at site. | Decentralized MCC & switchgear integrated into Process Blocks located in Primary Process Block module.<br>Feeders to loads are directly from decentralized MCCs and switchgears located in the Process Block without the need for interconnecting piperack.<br>Power distribution cabling is installed and terminated in module shop for Process Block interconnects with pre-terminated cable connectors, or coiled at module boundary for site interconnection of cross module feeders to loads within Process Blocks using pre-terminated cable connectors.<br>Ref.: Section 3.3E |
| Instrument and control systems | Control cabinets are either centralized in satellite substations or randomly distributed throughout process facility.<br>Instrument locations are fallout of piping and mechanical layout.<br>Vast majority of instrument cabling and termination is done in field for multiple cross module boundaries and stick-built portions via cable tray or misc. supports installed on interconnecting piperacks. | Control cabinets are decentralized and integrated into the Primary Process Block module.<br>Close coupling of instruments to locate all instruments for a system on a single Process Block module to maximum extent practical.<br>Instrumentation cabling installed and terminated in module shop.<br>Process Block module interconnects utilize pre-installed cabling pre-coiled at module boundary for site connection using pre-terminated cable connectors.<br>Ref.: Section 3.3F |

FIG. 4 is a schematic of three exemplary process blocks (#1, #2 and #3) in an oil separation facility designed for the oil sands region of western Canada. Here, process block #1 has two modules (#1 and #2), process block #2 has two modules (#3 and #4), and process block #3 has only one module (#5). The dotted lines between modules indicate open sides of adjacent modules, whereas the solid lines around the modules indicate walls. The arrows show fluid and electrical couplings between modules. Thus, Drawing 1 shows only two one electrical line connection and one fluid line connection between modules #1 and #2. Similarly, Drawing 1 shows no electrical line connections between process blocks #1 and 2, and only a single fluid line connection between those process blocks.

Figure 5:
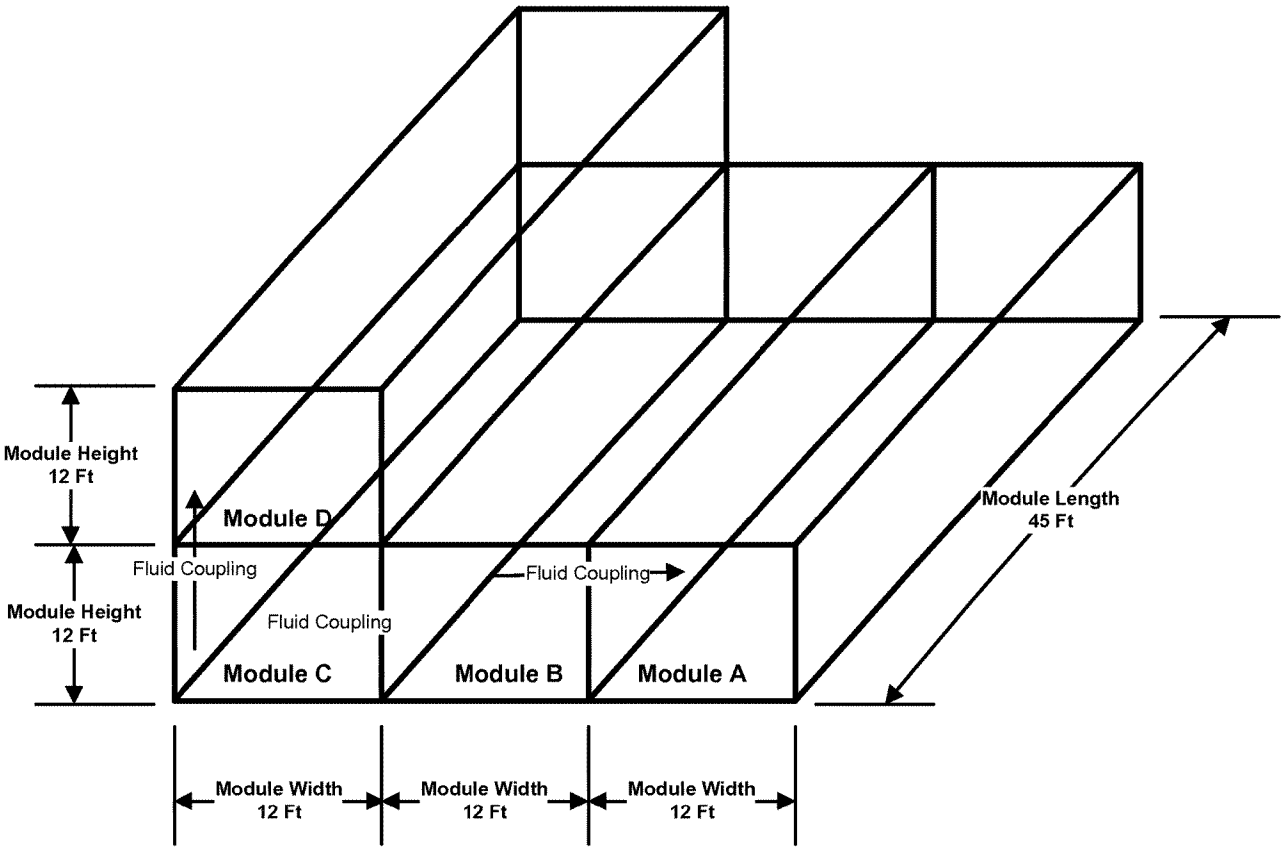
FIG. 5 is a schematic of a process block module layout elevation view, in which modules C, B and A are on one level, most likely ground level, with a fourth module D disposed atop module C.

FIG. 5 is a schematic of a process block module layout elevation view, in which modules C, B and A are on one level, most likely ground level, with a fourth module D disposed atop module C. Although only two fluid couplings are shown, the Drawing should be understood to potentially include one or more additional fluid couplings, and one or more electrical and control couplings.

Figure 6:
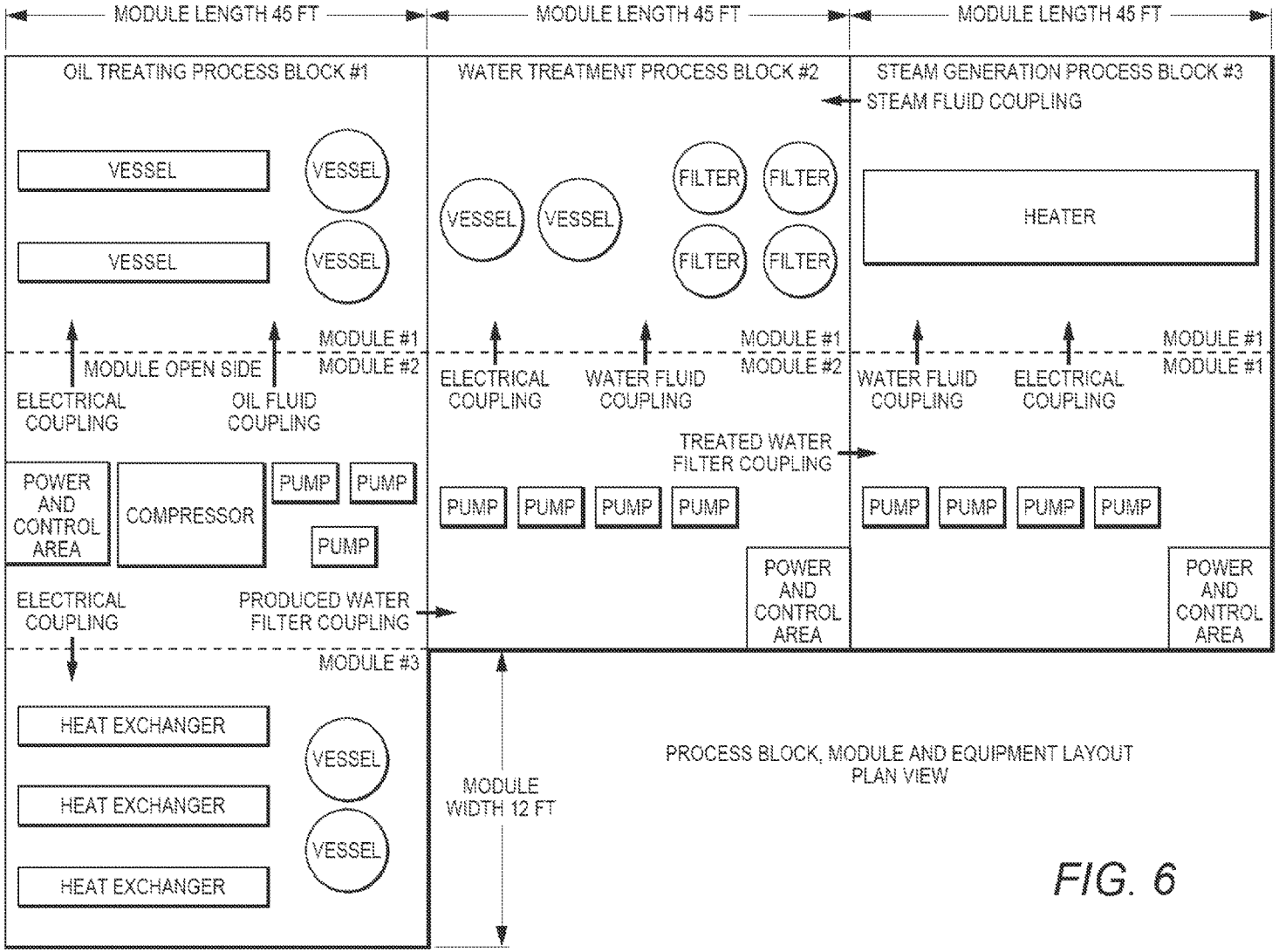
FIG. 6 is a schematic of an alternative embodiment of a portion of an oil separation facility in which there are again three process blocks (#1, #2 and #3).

FIG. 6 is a schematic of an alternative embodiment of a portion of an oil separation facility in which there are again three process blocks (#1, #2 and #3). But here, process block

#1 has three modules (#1, #2, and #3), process block #2 has two modules (#1 and #2), and process block #3 has two additional modules (#1 and #2).

Figure 7:
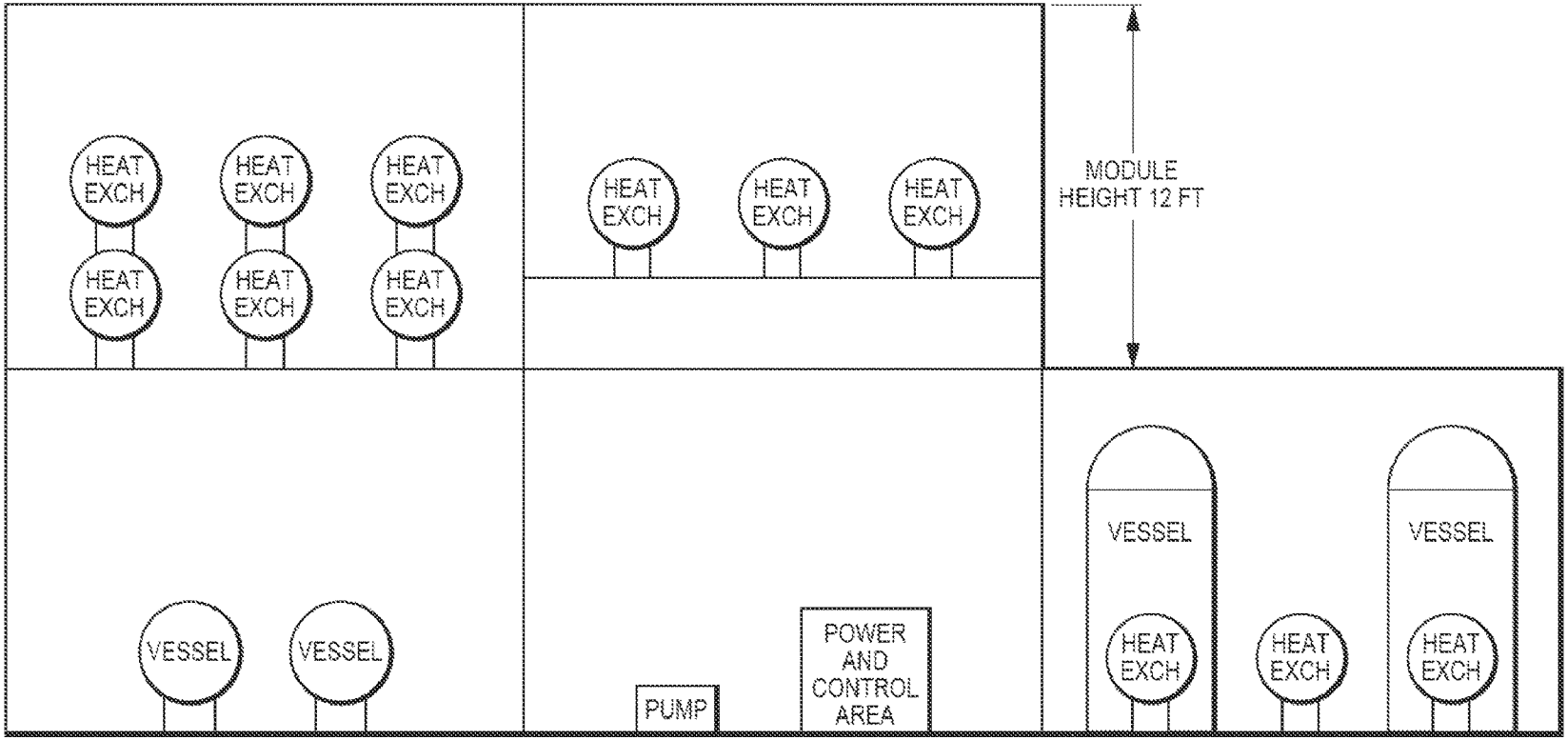
FIG. 7 is a schematic of the oil treating process block #1 of FIG. 3, showing the three modules described above, plus two additional modules disposed in a second story.

FIG. 7 is a schematic of the oil treating process block #1 of FIG. 3, showing the three modules described above, plus two additional modules disposed in a second story.

Figure 8:
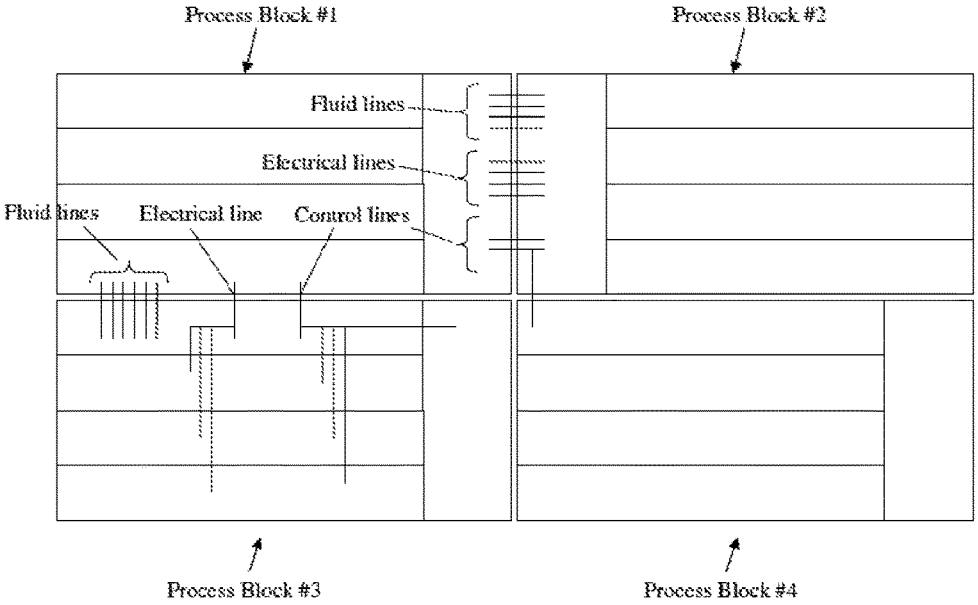
FIG. 8 is a schematic of a 3rd Generation Modular facility having four process blocks, each of which has five modules.

FIG. 8 is a schematic of a 3rd Generation Modular facility having four process blocks, each of which has five modules. Although dimensions are not shown, each of the modules should be interpreted as having (a) a length of at least 15 meters, (b) a height greater than 4 meters, (c) a width greater than 4 meters, and (d) having open sides and/or ends where the modules within a given process block are positioned adjacent one another. In this particular example, the first and second process blocks are fluidly coupled by no more four fluid lines, excluding utility lines, four electrical lines, and two control lines. The first and third process blocks are connected by six fluid lines, excluding utility lines, and by one electrical and one control line.

Also in FIG. 8, a primary electrical supply from process block 1 fans out to three of the four modules of process block 3, and a control line from process block 1 fans out to all four of the modules of process block 3.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A processing facility comprising:
- a first process block configured to carry out a first process;
- a second process block configured to carry out a second process;
- wherein the first process block comprises a first module fluidly coupled to a second module, the first module being abutted against the second module at a side-to-side edge interface;
- wherein the second process block comprises a third module fluidly coupled to a fourth module, the third module being abutted against the second module at an end-to-end edge interface; and
- wherein the second module is fluidly coupled to the third module via a first fluid line disposed entirely within an envelope of the second module and the third module and that is not run through an interconnecting piperack.

2. The facility of claim 1, wherein the first module is electrically coupled to the second module.

3. The facility of claim 1, wherein the third module is electrically coupled to the second module.

4. The facility of claim 1, wherein the first module is fluidly coupled to the second module via a second fluid line that is disposed entirely within an envelope of the first module and the second module and that is not run through an interconnecting piperack disposed external to the first module and the second module.

5. The facility of claim 4, wherein the third module is fluidly coupled to the fourth module via a third fluid line disposed entirely within an envelope of the third module and the fourth module and that is not run through an interconnecting piperack disposed external to the third module and the fourth module.

6. The facility of claim 1, wherein the second module is electrically coupled to the third module via an inter-module power distribution cable.

7. A method for constructing a modular processing facility at a project site comprising:
- providing a first process block configured to carry out a first process and comprising first and second modules;
- abutting the first and second modules along a first side-to-side edge interface;
- fluidly coupling the first and second modules;
- providing a second process block configured to carry out a second process different from the first process and comprising third and fourth modules;
- abutting the second and third modules along a first end-to-end edge interface; and
- fluidly coupling the second and third modules with a first fluid line disposed entirely within an envelope of the second and third modules and that is not run through an interconnecting piperack.

8. The method of claim 7, wherein providing the first process block comprises delivering each of the first and second modules to the project site by truck or flatbed.

9. The method of claim 7, further comprising allocating a plot space at the project site for each of the first and second process blocks.

10. The method of claim 7, further comprising communicatively coupling the first and second process blocks via one or more control lines.

11. The method of claim 7, further comprising fluidly coupling the third and fourth modules via a second fluid line that is disposed entirely within an envelope of the third and fourth modules and that is not run through an interconnecting piperack.

12. The method of claim 7, further comprising providing a third process block having a fifth module and abutting the fifth module with at least one of the third and fourth modules along a top-to-bottom edge interface such that the second and third process blocks are vertically arranged.

13. The method of claim 7, wherein the fluid and electrical coupling of the first and second process block is internal.

14. The method of claim 7, wherein each of the process blocks includes at least one of a vessel, a compressor, a heat exchanger, a pump, and a filter.

15. A processing facility comprising:
- a first process block comprising a first plurality of modules configured to together carry out a first process;
- a second process block comprising a second plurality of modules configured to together carry out a second process that is different from the first process;
- wherein at least one of the first plurality of modules of the first process block is abutted against at least one of the second plurality of modules of the second process block;
- wherein the at least one of the first plurality of modules of the first process block is fluidly coupled to the at least one of the second plurality of modules of the second process block with a first fluid line that is disposed entirely within an envelope of the first and second process blocks; and
- wherein the first plurality of modules are abutted against one another and are fluidly coupled with one another via a plurality of second fluid lines that are disposed entirely within the envelope of the first process block.

16. The facility of claim 15, wherein at least two of the first plurality of modules are configured differently from one another.

17. The facility of claim 16, wherein at least two of the second plurality of modules are configured differently from one another.

18. The facility of claim 15, wherein each of the first and second process blocks of the facility comprises a plurality of equipment from multiple disciplines.

19. The facility of claim 15, wherein the entire facility is located within a continuous geographic envelope, with each process block abutting at least one other process block.

20. The facility of claim 19, wherein each process block of the facility is fluidly coupled to at least one other process block of the facility without external piping.

* * * * *